US008913938B2

(12) United States Patent
Yonekawa

(10) Patent No.: US 8,913,938 B2
(45) Date of Patent: Dec. 16, 2014

(54) FIXING DEVICE AND IMAGE FORMATION APPARATUS

(75) Inventor: Noboru Yonekawa, Toyohashi (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 88 days.

(21) Appl. No.: 13/586,519

(22) Filed: Aug. 15, 2012

(65) Prior Publication Data

US 2013/0058691 A1 Mar. 7, 2013

(30) Foreign Application Priority Data

Sep. 2, 2011 (JP) ..... 2011-191362

(51) Int. Cl.
*G03G 15/20* (2006.01)

(52) U.S. Cl.
CPC ..... *G03G 15/2053* (2013.01)
USPC ..... 399/333; 399/328; 399/329

(58) Field of Classification Search
USPC ..... 399/328, 329, 333
See application file for complete search history.

(56) References Cited

U.S. PATENT DOCUMENTS

| | | | | |
|---|---|---|---|---|
| 5,520,223 | A * | 5/1996 | Iorio et al. | 138/140 |
| 2009/0263168 | A1* | 10/2009 | Baba | 399/329 |
| 2009/0317157 | A1* | 12/2009 | Murakami | 399/333 |
| 2010/0032308 | A1* | 2/2010 | Qi et al. | 205/164 |
| 2010/0196065 | A1* | 8/2010 | Matsuki et al. | 399/329 |
| 2011/0013956 | A1 | 1/2011 | Yonekawa | |
| 2011/0052284 | A1* | 3/2011 | Yonekawa | 399/333 |
| 2011/0135359 | A1* | 6/2011 | Kikuchi et al. | 399/333 |
| 2012/0080423 | A1 | 4/2012 | Takeda | |

FOREIGN PATENT DOCUMENTS

| | | |
|---|---|---|
| JP | 2009-258453 | 11/2009 |
| JP | 2010-2657 | 1/2010 |
| JP | 2010002657 A * | 1/2010 |
| JP | 2011-22385 | 2/2011 |
| WO | WO-2011/013824 | 2/2011 |

OTHER PUBLICATIONS

Notification of Reasons for Refusal mailed Nov. 12, 2013, directed to JP Application No. 2011-191362; 5 pages.

* cited by examiner

*Primary Examiner* — Ryan Walsh
(74) *Attorney, Agent, or Firm* — Buchanan Ingersoll & Rooney PC

(57) ABSTRACT

A fixing device comprising: an endless fixing belt having a multilayer structure including a non-magnetic conductive layer and a first magnetic conductive layer, the non-magnetic conductive layer having a thickness smaller than a skin depth of a material thereof, the first magnetic conductive layer having a thickness smaller than a skin depth of a material thereof and being located farther from an outside surface of the fixing belt than the non-magnetic conductive layer; and a supporting member disposed inside the endless fixing belt and including a second magnetic conductive layer having a thickness larger than a skin depth of a material thereof. The first magnetic conductive layer and the second magnetic conductive layer have a higher specific resistance than the non-magnetic conductive layer, and the first magnetic conductive layer has been manufactured by plastic forming or plating.

16 Claims, 6 Drawing Sheets

103

FIXING DEVICE AND IMAGE FORMATION APPARATUS

CROSS-REFERENCE TO RELATED APPLICATIONS

This application is based on application No. 2011-191362 filed in Japan, the contents of which are hereby incorporated by reference.

BACKGROUND OF THE INVENTION (1) Field of the Invention

The present invention relates to fixing devices and image formation apparatuses, and in particular to technology of improving both mechanical strength and heat generation efficiency of a fixing member, the fixing member being included in a fixing device that uses electromagnetic induction heating, and self-adjusting the amount of heat generation.

(2) Related Art

Conventionally, there has been a known technology of reducing energy consumption of a fixing device that uses electromagnetic induction by reducing warm-up time of the fixing device and omitting preheating during the stand-by period. According to this technology, a part of fixing member with a small thermal capacity, such as a belt, is caused to generate Joule heat by electromagnetic induction using an excitation coil.

To adjust the temperature of the fixing member included in such a fixing device, a structure using magnetic shunt alloy has been proposed (Japanese Patent Application Publication No. 2010-2657). Specifically, the above publication proposes providing the fixing member with a primary heat generator layer (induction heat generator layer) made of copper (Cu) and a heat generation control layer made of magnetic shunt alloy. At or below the Curie temperature, the heat generation control layer serves as a ferromagnetic. The heat generation control layer attracts the magnetic flux generated by the excitation coil and concentrates the induced current (i.e. eddy current) to the primary heat generator layer so that the primary heat generator layer efficiently generates Joule heat.

Above the Curie temperature, the heat generation control layer serves as a paramagnetic, and passes the magnetic flux generated by the excitation coil. Hence, the magnetic flux density within the primary heat generator layer is decreased, which leads to reduction of the amount of heat generation. The magnetic flux passing through the heat generation control layer is led toward the core bar serving as a magnetic flux suppression layer. This structure prevents the non-sheet conveyance region from being overheated when small sheets are sequentially conveyed (i.e. self-adjustment of the amount of heat generation).

Permalloy (Fe—Ni alloy) is one commonly-used example of magnetic shunt alloy having a Curie temperature close to the fixing temperature and changing greatly in its magnetic permeability. Permalloy, however, does not have a high mechanical strength, and there is a problem that a fixing member using permalloy is likely to be damaged.

In addition, permalloy essentially requires annealing to obtain preferable magnetism. If annealing is performed on the entire fixing member containing permalloy, the mechanical strength of copper contained in the induction heat generator layer will be degraded as well as the mechanical strength of the permalloy, and it is impossible to obtain the strength required by a fixing member for a fixing device.

Although there is an option to first perform annealing on permalloy alone and then to form the heat generator layer by electrolytic plating, annealing forms a hard oxide layer on the surface of permalloy, and it is therefore difficult to obtain necessary peel strength between the heat generator layer and the permalloy.

Another option is to first perform annealing on a multilayer layer structure including: a layer of cladded permalloy (heat generation control layer); a layer of copper (primary heat generator layer); and a layer of Ni (antioxidant layer), and then to form a reinforcing layer by electrolytic plating. However, if the reinforcing layer is adequately formed on the surface closer to the excitation coil in order to secure the mechanical strength, the heat generation efficiency will be degraded.

SUMMARY OF THE INVENTION

The present invention is made in view of the problems described above, and aims to provide a fixing device including a fixing member effectively self-adjusting the amount of heat generation and having adequate mechanical strength and heat generation efficiency. The present invention also provides an image formation apparatus provided with the same.

To achieve the aim, a fixing device pertaining to the present invention is a fixing device for fixing a toner image on a recording sheet after fusing the toner image by using a fixing belt heated due to electromagnetic induction caused by an excitation coil, comprising: an endless fixing belt having a multilayer structure including a non-magnetic conductive layer and a first magnetic conductive layer, the non-magnetic conductive layer having a thickness smaller than a skin depth of a material thereof, the first magnetic conductive layer having a thickness smaller than a skin depth of a material thereof and being located farther from an outside surface of the endless fixing belt than the non-magnetic conductive layer; and a supporting member disposed inside the endless fixing belt and including a second magnetic conductive layer having a thickness larger than a skin depth of a material thereof, wherein the first magnetic conductive layer and the second magnetic conductive layer have a higher specific resistance than the non-magnetic conductive layer, and the first magnetic conductive layer has been manufactured by plastic forming or plating.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENT

The following describes an embodiment of a fixing device and an image formation apparatus pertaining to the present invention, with reference to the drawings.

[1] Structure of Image Formation Apparatus

First, the following describes the structure of an image formation apparatus pertaining to the present embodiment.

Figure 1:
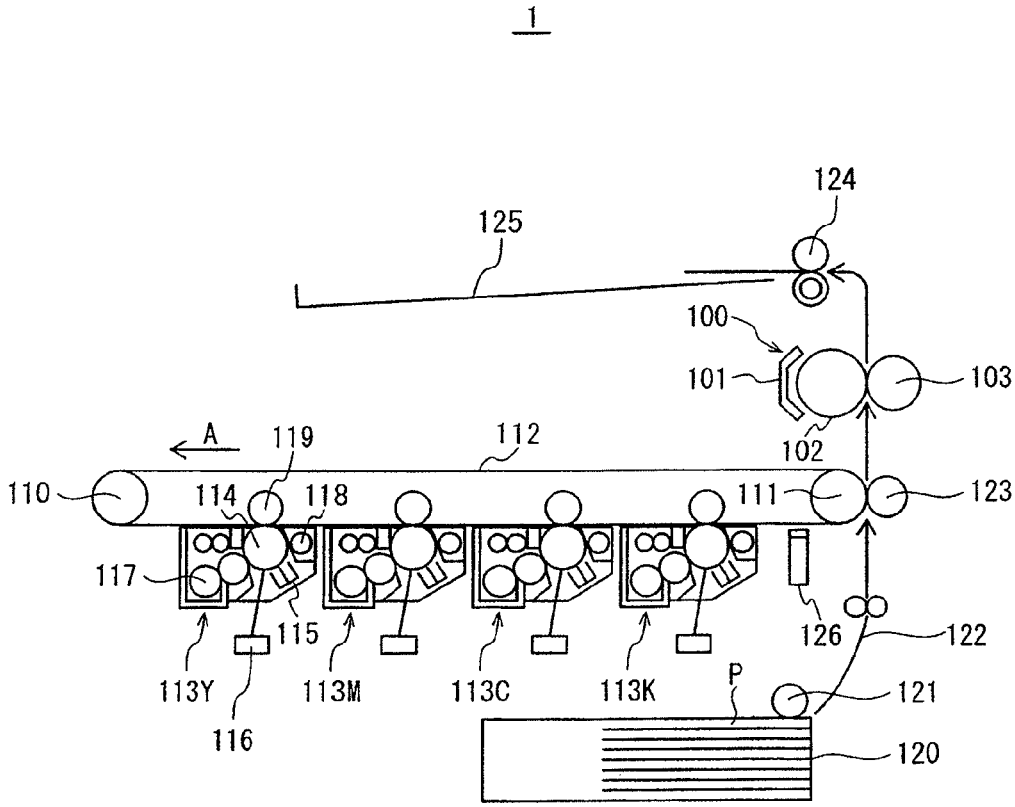
FIG. 1 shows primary components of an image formation apparatus pertaining to an embodiment of the present invention.

FIG. 1 shows primary components of the image formation apparatus pertaining to the embodiment. As shown in FIG. 1, the image formation apparatus 1 is a tandem color printer, and is provided with an intermediate transfer belt 112, which is suspended with tension between a drive roller 110 and a passive roller 111 and is rotated in the direction indicated by the arrow A in the drawing. The image formation apparatus 1 is also provided with image formation sections 113Y-113K which are arranged along the portion of the intermediate transfer belt 112 extending from the drive roller 110 to the passive roller 111. The image formation sections 113Y-113K respectively form toner images of the colors yellow (Y), magenta (M), cyan (C) and black (K).

Each of the image formation sections 113Y-113K includes a photosensitive drum 114, a charging device 115, an exposure device 116, a developer 117 and a cleaner 118. The charging device 115, the exposure device 116, the developer 117 and the cleaner 118 are arranged along the rotation direction of the photosensitive drum 114. The outer circumferential surface of the photosensitive drum 114 is, while being rotated, uniformly charged by the charging device 115. An electrostatic latent image is formed on the outer circumferential surface by the exposure device 116, and the electrostatic latent image is developed to be a toner image by the developer 117.

The photosensitive drum 114 faces the primary transfer roller 119 with the intermediate transfer belt 112 intervened therebetween. The toner image carried on the outer circumferential surface of the photosensitive drum 114 is electrostatically transferred onto the intermediate transfer belt 112. Afterward, by the cleaner 118, the electricity on the photosensitive drum 114 is removed and residual toner on the outer circumferential surface is scraped off. The toner images of YMCK colors formed by the image formation sections 113Y-113K are thus sequentially transferred onto the intermediate transfer belt 112 so as to overlap with each other to form a color toner image. The color image is transported toward the passive roller 111.

A paper feeder 120 houses recording sheets P. Along with the operations described above, the paper feeder 120 sends out the recording sheets P one by one to a transport passage 122 by using a paper feed roller 121. While each recording sheet P thus sent out is passing through a secondary transfer nip formed between the passive roller 111 and a secondary transfer roller 123, the toner image carried on the intermediate transfer belt 112 is electrostatically transferred onto the recording sheet P.

The fixing device 100 uses electromagnetic induction heating. Alternating flux generated by a flux generator 101 heats the fixing member 102 by electromagnetic induction. The recording sheet P carrying the toner image is passed through the fixing nip formed between the fixing member 102 and the pressure roller 103, and thus the toner image is fused, and then transferred onto the recording sheet P by pressure. The recording sheet P, on which the toner image has been fixed, is ejected onto a catch tray 125 by an ejection roller 124.

An image density sensor 126 is provided on the transport passage of the intermediate transfer belt 112 from the image formation section 113K to the passive roller 111. The image density sensor 126 detects the density of the toner carried on the intermediate transfer belt 112, and serves as a registration sensor during the processing for image stabilization, for example.

[2] Structure of Fixing Device 100

Next, the following further describes the structure of the fixing device 100.

Figure 2:
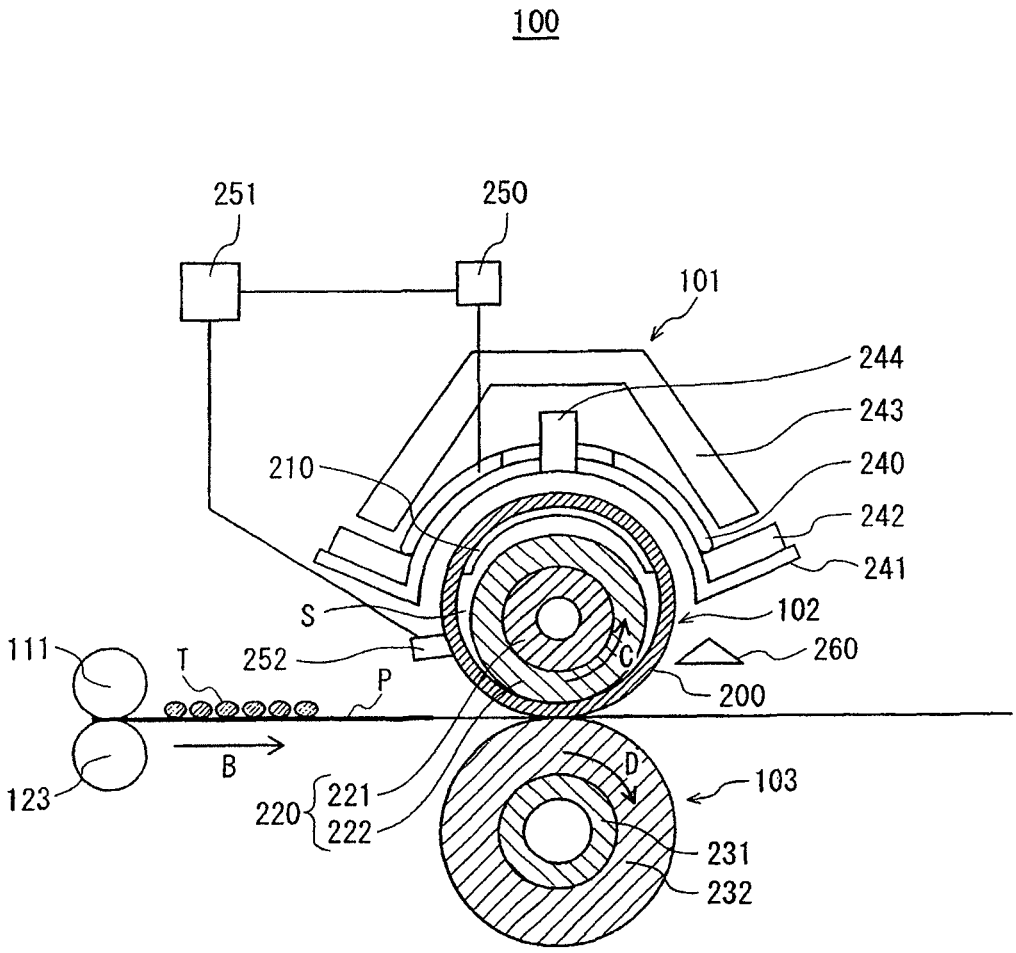
FIG. 2 is a cross-sectional view showing primary components of a fixing device 100.

FIG. 2 is a cross-sectional view showing primary components of the fixing device 100. As shown in FIG. 2, the fixing member 102 includes: an endless fixing belt 200 running circularly; and a supporting member 210 and a fixing roller 220 disposed inside the running path of the fixing belt 200. The fixing roller 220 and the pressure roller 103 sandwich the fixing belt 200. The fixing roller 220 and the pressure roller 103 are arranged so that their respective rotation shafts are in parallel. The pressure roller 103 is biased so as to be pressed against the fixing member 102, and thus the fixing nip is formed.

When the pressure roller 103 is rotated by the drive source (not depicted in the drawing) in the direction indicated by the arrow D, the fixing belt 200 and the fixing roller 220 are accordingly rotated in the direction indicated by the arrow C due to the friction caused by the pressure roller 103, the fixing belt 200 and the fixing roller 220 with each other. In parallel with the above operation, the recording sheet P carrying the toner image T is transported in the direction indicated by the arrow B. The toner image is fixed on the sheet at the fixing nip, and then the sheet is separated from the fixing member 102 by a separation nail 14. The drive-driven relationship between the pressure roller 103 and the fixing roller 220 may be the other way around. That is, the pressure roller 103 may be driven by the fixing roller 220.

Figure 3:
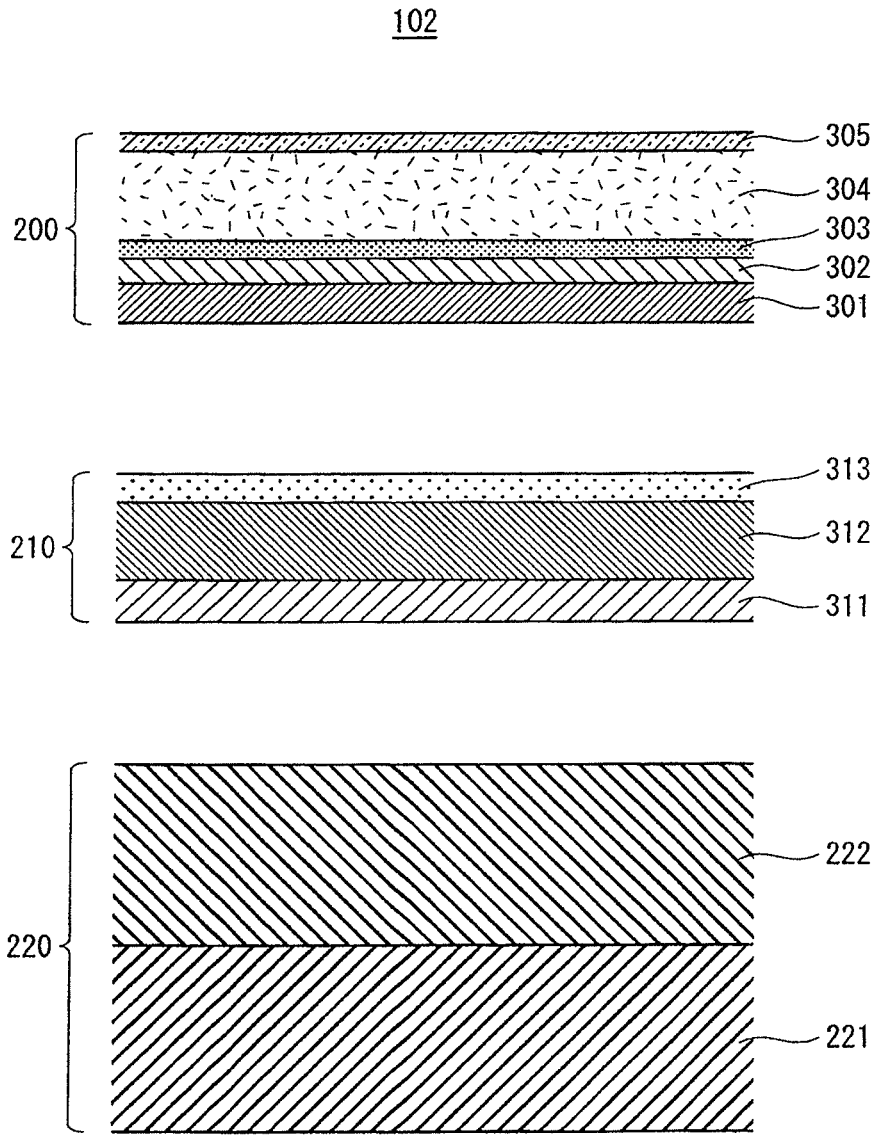
FIG. 3 is a cross-sectional view schematically showing a structure of a fixing member 102.

The supporting member 210 included in the fixing member 102 has an arc-shaped cross-section. The supporting member 210 supports the portion of the fixing belt 200 closer to the magnetic flux generator 101 of the fixing roller 220 from the inside of the running path of the fixing belt 200. The supporting member 210 and the fixing roller 220 have approximately the same length in the rotation shaft direction of the fixing roller 220. FIG. 3 is a cross-sectional view schematically showing the multilayer structure of the components of the fixing member 102.

Fixing Roller 220

As shown in FIG. 3, the fixing roller 220 is made up by bonding a heat insulating layer 222 to the outer circumferential surface of a core bar 221 which is columnar. The core bar 221 supports the entire body of the fixing roller 220, and is made of stainless or steel, because it needs to have adequate thermal resistance and strength. Alternatively, if aluminum (Al) is used, the core bar 221 is prevented from being heated by electromagnetic induction, which leads to reduction of heat generation loss.

The heat insulating layer 222 has a low thermal conductivity in order to prevent heat from escaping from the fixing belt 200 to the core bar 221, and is a sponge-like structure (heat insulative structure) made of a rubber material or a resin material having thermal resistance and elasticity. The use of such a material allows the fixing belt 200 to flex, and contributes to keeping the fixing nip large in width. It also contributes to reducing the hardness of the entirety of the fixing roller 220, and improves the performance of fixing and paper transportation. The same effect can be achieved when the heat insulating layer 222 has a double-layer structure including a solid layer and a sponge-like layer.

When a silicone sponge is used as a material of the heat insulating layer 222, it is preferable that the heat insulating layer 222 has a thickness falling within the range of 1 mm to 10 mm, and more preferably, within the range of 2 mm to 7 mm. The hardness thereof preferably falls within the range of 20 degrees to 60 degrees in Asker C hardness, and more preferably, within the range of 30 degrees to 50 degrees. The roller hardness of the entirety of the fixing roller 220 preferably falls within the range of 30 degrees to 90 degrees in Asker C hardness.

Supporting Member 210

The following describes the structure of the supporting member 210.

The supporting member 210 includes a supporting heat generation layer 311, and a heat generation control layer 312 and a protection layer 313 laminated on the supporting heat generation layer 311 in the stated order. The protection layer 313 makes contact with the fixing belt 200. The supporting heat generation layer 210 is made of non-magnetic material, and its relative permeability preferably falls within the range of 0.99 to 2.0, and more preferably, within the range of 0.99 to 1.1. The volume resistivity of the supporting heat generation layer preferably falls within the range of $1.0\times10^{-8}$ Ωm to $10.0\times10^{--8}$ Ωm, and more preferably within the range of $1.0\times10^{-8}$ Ωm to $2.0\times10^{-8}$ Ωm.

In particular, in the present embodiment, an aluminum material having a thickness of 0.4 mm, which falls within the range of 0.2 mm to 2.0 mm, is used as the material of the supporting heat generation layer 311. With such a structure, the supporting heat generation layer 311 exhibits a lower volume resistivity than the heat generation control layer 312 at a high temperature. Here, the term "high temperature" is defined as a temperature that is excessively high in view of the purpose of fixing. In the present embodiment, the "high temperature" is higher than the Curie temperature of the heat generation control layer 312. SUS (stainless steel) or copper may be used instead as the material of the supporting heat generation layer 311 only if the relative permeability and the volume resistivity of the material fall within the ranges described above.

The heat generation control layer 312 is made of a magnetic material having a higher volume resistivity at room temperature than the supporting heat generation layer 311 and a primary heat generator layer 302 of the fixing belt 200, which will be described later. In the present invention, the heat generation control layer 312 is made of permalloy having a Curie temperature of 220° C., which is higher than the fixing temperature. When the fixing temperature is 180° C. for example which falls within the range of 170° C. to 190° C., the Curie temperature preferably falls within the range of 180° C. to 240° C., and more preferably within the range of 190° C. to 220° C. Since the Curie temperature of permalloy will be increased by increasing the rate of nickel (Ni) content, the Curie temperature can be adjusted by changing the proportions of the contents. Also, the Curie temperature of the permalloy can be adjusted by using, for example, chrome (Cr), cobalt (Co) or molybdenum (Mo).

The relative permeability of the heat generation control layer 312 preferably falls within the range of 50 to 2000, and more preferably within the range of 100 to 1000. Below the Curie temperature, the volume resistivity preferably falls within the range of $2.0\times10^{-8}$ Ωm to $200.0\times10^{4}$ Ωm, and more preferably within the range of $5.0\times10^{-8}$ Ωm to $100.0\times10^{-8}$ Ωm. The thickness of the heat generation control layer 312 preferably falls within the range of 100 μm to 1000 μm, and more preferably within the range of 200 μm to 600 μm. In the present embodiment, the heat generation control layer 312 has a thickness of 400 μm.

The protection layer 313 protects the heat generation control layer 312 from wearing by friction, and oxidization. The protection layer 313 is preferably formed by coating the heat generation control layer 312 with chrome, nickel, or alloy containing chrome or nickel. The thickness of the protection layer 313 preferably falls within the range of 1 μm to 5 μm.

First, the supporting heat generation layer 311 and the heat generation control layer 312 are separately formed by press working, and then the heat generation control layer 312 is subject to annealing for approximately thirty minutes to two hours in a vacuum furnace or a furnace that has been undergone nitrogen gas displacement. Thus, the crystal grains of the magnetic material of the supporting member 210 are increased in size, and the magnetic properties of the supporting member 210 are thereby recovered. Then, the protection layer 313 is formed by plating.

Fixing Belt 200

Next, the following describes the structure of the fixing belt 200.

The fixing belt 200 includes: a reinforcing layer 301; a primary heat generator layer 302; an antioxidant layer 303; an elastic layer 304; and a releasing layer 305, laminated in the stated order, where the reinforcing layer 301 is the innermost layer with respect to the running path.

The reinforcing layer 301 is a layer for securing the strength of the fixing belt 200. The reinforcing layer 301 is preferably made of a magnetic material so as not to degrade the heat generation performance of the primary heat generator layer 302. When a magnetic material is used, eddy current flows only in a region close to the surface of the reinforcing layer 301 due to skin effect even if the reinforcing layer 301 is thick, and the primary heat generator layer 302 is prevented from being degraded in its heat generation performance. To achieve such an effect, the reinforcing layer 301 preferably has a relative permeability falling within the range of 50 to 2000 and a thickness falling within a range of 10 μm to 80 μm.

The reinforcing layer 301 should be made of a material having high hardness and corrosion resistance, such as nickel, nickel alloy and SUS. The reinforcing layer 301 preferably has a hardness falling within the range of 200 Hv to 2000 Hv in Vickers hardness. In the present embodiment, the reinforcing layer 301 is formed to have a thickness of 40 μm by electroforming (i.e. nickel plating).

The reinforcing layer 301 preferably has a higher volume resistivity than the primary heat generator layer 302. The volume resistivity of the reinforcing layer 301 preferably falls within the range of $1.0\times10^{-8}$ Ωm to $100.0\times10^{-8}$ Ωm, and more preferably within the range of $10.0\times10^{-8}$ Ωm to $50.0\times10^{-8}$ Ωm. With such a structure, eddy current occurring near the surface of the reinforcing layer 301 closer to the primary heat generator layer 302 is led to the primary heat generator layer 302, which has a lower volume resistivity than the reinforcing layer 301, by electromagnetic induction. Thus, the primary heat generator layer 302 is prevented from being degraded in its heat generation performance.

Figure 5:
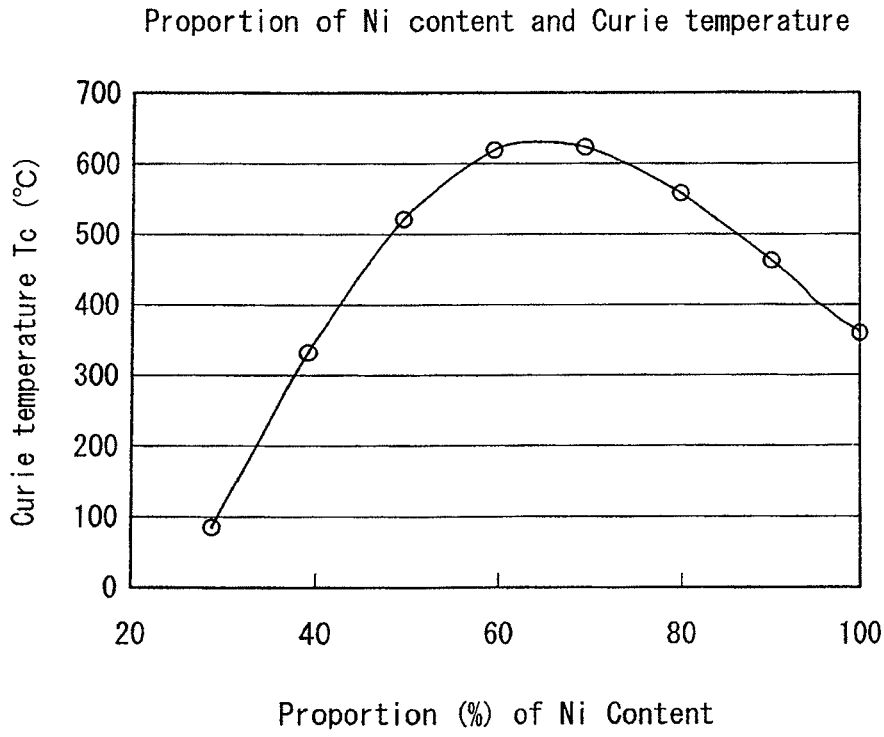
FIG. 5 is a graph showing a relationship between a proportion of nickel content and Curie temperature Tc.

The reinforcing layer 301 preferably has a higher Curie temperature than the heat generation control layer 312. The Curie temperature of the reinforcing layer 301 preferably falls within the range of 250° C. to 500° C. With such a structure, the heat generation by the fixing belt 200 as a whole is suppressed when the temperature of the reinforcing layer 301 exceeds the Curie temperature. This prevents an abnormal temperature rise. The heat generation control layer 312 is made of permalloy. The Curie temperature of the heat generation control layer 312 can be adjusted by changing the proportion of the nickel content in permalloy (c.f. FIG. 5).

The primary heat generator layer 302 generates heat due to induced current induced by magnetic flux generated by the flux generator 101. The primary heat generator layer 302 may be made of a non-magnetic material, such as copper and silver (Ag). Copper is used in the present embodiment. Due to the presence of the heat generation control layer 312 having a high magnetic permeability, even when the primary heat generator layer 302 is made of a non-magnetic material, the effect of inductive coupling occurs at a high degree and preferable heat generation efficiency can be achieved as long as the primary heat generator layer 302 has a small thickness. For the reasons described above, it is preferable that the primary heat generator layer 302 has a thickness falling within the range of 5 μm to 20 μm.

The antioxidant layer 303 is a layer for protecting the primary heat generator layer 302 from oxidization. The antioxidant layer 303 prevents the primary heat generator layer 302 from being exposed to the open air (i.e. atmosphere) and being coated with an oxide layer, and hence the primary heat generator layer 302 and the elastic layer 304 are kept bonded to each other in a preferable state for a long period. In particular, when the primary heat generator layer 302 is made of copper, the oxide layer grows fast, and is likely to have a low strength. Since such an oxide layer is likely to peel off, the use of antioxidant layer 303 is effective in this case.

The antioxidant layer 303 is preferably made of a metal material that realizes high sealing performance, in view of the necessity of blocking airflow. In order to reduce the degradation of heat generation performance, the antioxidant layer 303 is preferably made of a non-magnetic, low resistance material so as to be thin. Nickel, chrome, and silver materials are appropriate for the antioxidant layer 303, because they have small influence on the heat generation performance and can be bonded to the elastic layer 304 in a preferable state. It is preferable that the antioxidant layer 303 has a thickness falling within the range of 0.5 μm to 40 μm. When the thickness is less than 0.5 μm, pinholes are likely to occur in the antioxidant layer 303, and it will be difficult to achieve sufficient sealing performance. Moreover, since the antioxidant layer 303 is formed on the surface of the primary heat generator layer 302 closer to the flux generator 101, the thickness greater than 40 μm of the antioxidant layer 303 degrades the heat generation performance decreases, and in particular, degrades the effect of preventing the excessive temperature rise.

The antioxidant layer 303 may be made of polyimide resin. Since polyimide resin is an insulative material, it has absolutely no influence on the heat generation performance. Hence, considering that polyimide resin has lower sealing performance than the metal material, it is preferable that the thickness of the antioxidant layer 303 falls within the range of 3 μm to 70 μm. When polyimide resin is used, if the antioxidant layer 303 has a thickness less than 3 μm, the antioxidant layer 303 cannot sufficiently seal the primary heat generator layer 302, and therefore an oxide layer will be formed on the surface of the primary heat generator layer 302. On the other hand, a thickness greater than 70 μm is not preferable, because it degrades the thermal efficiency in conducting the heat generated by the primary heat generator layer 302 to the outer circumferential surface of the fixing belt 200.

The elastic layer 304 is a layer for uniformly and flexibly conducting heat to the toner image to be fixed. Due to the elasticity of the elastic layer 304, the occurrence of image noises caused by a squished or ununiformly fused toner image are prevented. The elastic layer 304 is preferably made of a rubber material or a resin material having thermal resistance and elasticity. For example, thermal resistant elastomer such as silicone rubber or fluorine-containing rubber enduring the fixing temperature is suitable. Filler (filling material) may be mixed in the materials described above to give them thermal conductivity or to reinforce them. Examples of filler for improving the thermal conductivity include diamond, silver, copper, aluminum, marble and glass. Practically, silica ($SiO_2$), alumina ($Al_2O_3$), magnesium oxide (MgO), boron nitride (BN), or beryllium oxide (BeO) may be used, for example.

The elastic layer 304 preferably has a thickness falling within the range of 10 μm to 800 μm, and more preferably within the range of 100 μm to 300 μm. When the elastic layer 304 has a thickness less than 10 μm, it is difficult for the elastic layer 304 to have sufficient elasticity in the thickness direction of the elastic layer 304. On the other hand, a thickness greater than 800 μm is not preferable, because it degrades the thermal efficiency in conducting the heat generated by the primary heat generator layer 302 to the outer circumferential surface of the fixing belt 200.

The hardness of the elastic layer 304 preferably falls within the range of 1 degree to 80 degrees in Japanese Industrial Standards (JIS) hardness, and more preferably, within the range of 5 degrees to 30 degrees. Such a structure prevents degradation in strength and adhesiveness of the elastic layer 304, and secures stable performance of fixing. Example materials having such hardness include one-component, two-component, or three or more-component silicone rubber, Low Temperature Vulcanizable (LTV), Room Temperature Vulcanizable (RTV), or High Temperature Vulcanizable (HTV) silicone rubber, and condensed or addition silicone rubber. In the present embodiment, a silicone rubber having a JIS hardness of 10 degrees and a thickness of 200 μm is used.

For manufacturing the fixing belt 200, first, the reinforcing layer 301, the primary heat generator layer 302 and the antioxidant layer 303 are layered to form a sleeve-like shape by electroplating. Alternatively, the reinforcing layer 301, the primary heat generator layer 302 and the antioxidant layer 303 may be first cladded by rolling to form a plate-like shape, and then processed to form a sleeve-like shape by plastic forming such as drawing, spinning, and drawing and ironing (DI).

Figure 6:
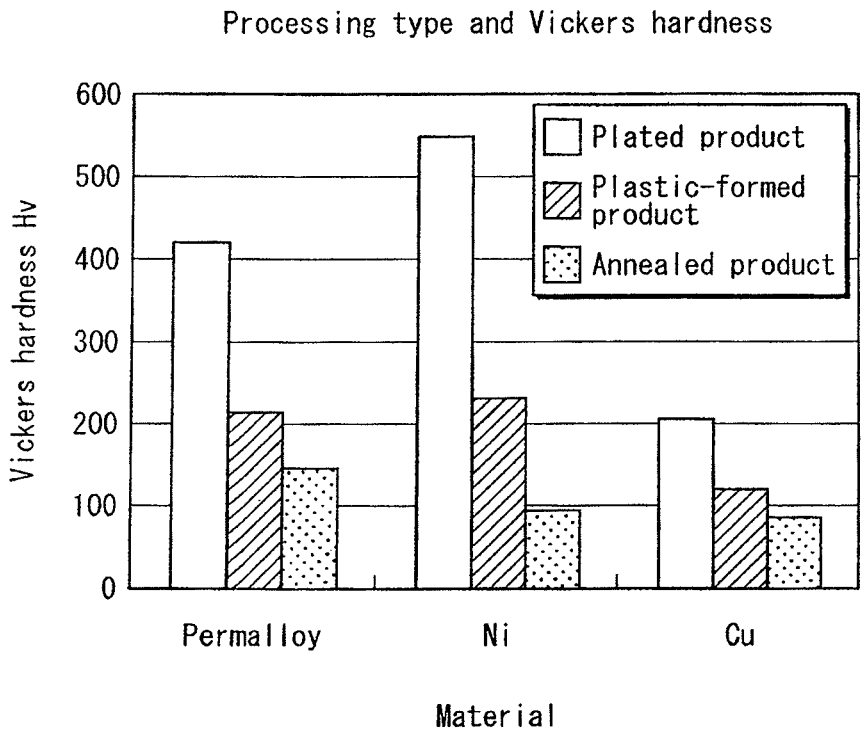
FIG. 6 is a graph showing a relationship between processing types and material hardness.

After that, the antioxidant layer 303 is coated first with the elastic layer 304, and then with the releasing layer 305. As a result, the fixing belt 200 will be given sufficient mechanical strength and peel strength. In this regard, changes in material hardness depending on the types of processing were tested by experiment. A permalloy material containing 34% of nickel, a pure nickel material, and a pure copper material are each formed in a plate-like shape by plating and plastic forming. Annealed products are also prepared by annealing plated products at 800° C. for 1 hour, and Vickers hardness is measured for each by using a micro Vickers hardness meter. FIG. 6 is a graph showing a relationship between processing types and material hardness. As can be seen from FIG. 6, the nickel- and copper-plated products have a higher hardness than the annealed permalloy product.

Also, since the reinforcing layer 301, the primary heat generator layer 302 and the antioxidant layer 303 have a high hardness as described above, the fixing belt is given high durability. In the present embodiment in particular, since the reinforcing layer 301 is formed by plating or plastic forming and the reinforcing layer 301 is layered on the surface of the primary heat generator layer 302 opposite to the excitation coil, degradation of the heat generation efficiency is prevented without decreasing the magnetic flux density of the primary heat generator layer 302, which leads to sufficient mechanical strength.

Fixing Member 102

The embodiment has been described above for the case where the supporting member 210 makes contact with the fixing belt 200. However, the present invention does not necessarily have such a structure. The supporting member 210 and the fixing belt 200 may be isolated from each other.

As shown in FIG. 2, the outside diameter of the fixing roller 220 is smaller than the inside diameter of the fixing belt 200, and the supporting member 210 is disposed within a space S located therebetween. The supporting member 210 has a shape formed by cutting a cylinder along two planes including the central axis thereof. Almost the entire primary surface closer to the protection layer 313 is in contact with the inside surface of the fixing belt 200. The fixing roller 220 is also in contact with the fixing belt 200 at a different location than the supporting member 210.

In this case, it is preferable that the outside diameter of the fixing roller 220 is as short as possible, only if the fixing nip can be formed. This is because the amount of thermal loss is reduced as the outside diameter is decreased, since the contact area between the fixing belt 200 and the fixing roller 220 decreases as the outside diameter decreases, and heat will be prevented from conducting from the fixing belt 200 to the fixing roller 220. Similarly, a heat loss from the supporting member 210 can be reduced by limiting the contact area between the supporting member 210 and the fixing belt 200. Thus, such a devise reduces the warm-up time.

Pressure Roller 103

The following descries the pressure roller 103.

Figure 4:
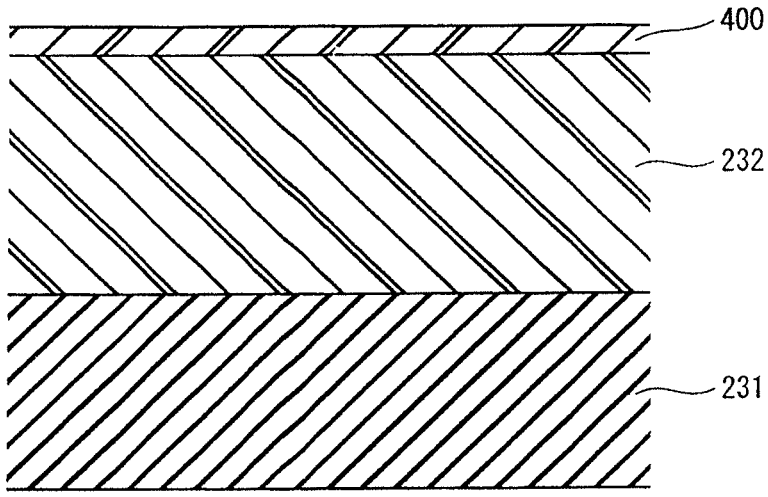
FIG. 4 is a cross-sectional view showing a structure of a pressure roller 103.

FIG. 4 is a cross-sectional view showing the structure of the pressure roller 103. As shown in FIG. 4, the pressure roller 103 is made up by laminating the heat insulating layer 232 and the releasing layer 400 in this order on the outer circumferential surface of the core bar 231.

The core bar 231 is an aluminum pipe having a wall thickness of 3 mm. The core bar 231 may be a molded pipe made of a thermal-resistant material such as PPS (polyphenylene sulfide), only if its strength can be secured. Although it is not impossible to use a steel pipe as the core bar 231, it is preferable that the core bar 231 is made of a non-magnetic material that is unlikely to be influenced by electromagnetic induction.

On the outer circumferential surface of the core bar 231, the heat insulating layer 232 is formed. The heat insulating layer 232 is made of a silicone sponge rubber, and preferably has a thickness falling within the range of 3 mm to 10 mm. The heat insulating layer 232 may have a double-layer structure composed of a silicone rubber and a silicone sponge.

On the outer circumferential surface of the heat insulating layer 232, the releasing layer 400 is formed. Similarly to the releasing layer 305 of the fixing belt 200, the releasing layer 400 is a layer for improving the release characteristics in releasing the recording sheets. The releasing layer 400 is made of a fluorine-containing resin, such as PFA or PTFE, and preferably has a thickness falling within the range of 10 μm to 50 μm. In the present embodiment, the pressure roller 103 is pressed against the fixing member 102 with a load of approximately 300 N to 500 N, and accordingly a fixing nip having a width of approximately 5 mm to 15 mm is formed. The width of the fixing nip can be adjusted by changing the load with which the pressure roller 103 is pressed against the fixing member 102.

Flux Generator 101

The following explains the flux generator 101.

The flux generator 101 is disposed along the outer circumferential surface of the fixing belt 200, and faces the supporting member 210 with fixing belt 200 interposed therebetween. The longitudinal direction of the flux generator 101 coincides with the rotation shaft direction of the fixing belt 200. As shown in FIG. 2, the flux generator 101 includes an excitation coil 240, a coil bobbin 241, a hem core 242, a main core 243 and a center core 244.

The excitation coil 240 is a coil wound along the outer circumferential surface of the fixing belt 200, and its longitudinal direction coincides with the rotation shaft direction of the fixing belt 200. When viewed in the perpendicular direction to the rotation shaft of the fixing belt 200, the excitation coil 240 has a shape curving along the circumference of the fixing belt 200. The excitation coil 240 is connected with a high-frequency inverter 250, and its frequency falls within the range of 20 kHz to 80 kHz. The excitation coil 240 is supplied with an AC power falling within the range of 100 W to 2000 W, and generates an alternating magnetic field. The frequency within the stated range realizes high heat generation efficiency, which leads to a sufficiently high fixing temperature. When the frequency is lower than 20 kHz, the heat generation efficiency is significantly low and does not meet the requirement for practical use. When the frequency is higher than 80 kHz, power supply shortage may occur while a number of recording sheets are consecutively transported, and the temperature of the fixing belt 200 may not be raised to a sufficiently high temperature. This can be a cause of a fixing failure.

In the present Embodiment, a litz wire formed by twisting a several tens of or several hundreds of wires together is used as the excitation coil 240. This coil is coated with thermal resistant resin so that the excitation coil 240 maintains its insulation when it is supplied with power and it generates heat. Further improvement in the safety can be achieved by cooling the excitation coil 240 by using a fan while being supplied with power. In the present embodiment, the excitation coil 240 is formed as a single piece, and, for example, is not divided into segments in the rotation shaft direction of the fixing belt 200.

The hem core 242, the main core 243 and the center core 244 (these cores are hereinafter collectively called as "magnetic cores") are used for improving the efficiency of the magnetic circuit and for shielding the magnetism. As shown in FIG. 2, the main core 243 has an arch-like cross-section. In the present embodiment, thirteen core pieces having a length of approximately 10 mm are arranged in the rotation shaft direction of the fixing belt 200. Alternatively, a core having an E-shaped cross-section, in which the central portion extends toward the center core 244, may be used instead of the main core 243. A core having an E-shaped cross-section further improves the heat generation efficiency.

The center core 244 has a square-shaped cross-section, and includes core pieces arranged in the center of the coil bobbin 241, each having a length falling within the range of 5 mm to 10 mm. The hem core 242 has a square-shaped cross-section. The hem core 242 is disposed so as to face the fixing belt 200 along the entire length of the fixing belt 200 at either end of the coil bobbin 241, and no gap is formed in the rotation shaft direction of the fixing belt 200.

Each of the magnetic cores has a high magnetic permeability, and is made of a material with a low eddy current loss. The magnetic cores preferably have a Curie temperature falling within the range of 140° C. to 220° C., and more preferably, within the range of 160° C. to 200° C. When the magnetic cores are made of alloy having high magnetic permeability such as permalloy, a loss due to the eddy current is likely to increase. In such a case, however, a loss due to the eddy current can be suppressed by using cores having a multilayer structure in which thin plates are layered.

The improvement in the efficiency of the magnetic circuit and shielding of the magnetism may be realized by other means than the magnetic cores. The magnetic cores may be made of a resin material on which magnetic power is dispersed. Although such a resin material has as relatively low magnetic permeability, it has an advantage that its shape can be deter mined freely.

Adjustment of Fixing Temperature

Next, the following describes the structure for adjusting the fixing temperature.

The fixing device 100 includes a thermistor 252 for measuring the surface temperature of the fixing belt 200. The thermistor 252 is located a little upstream from the entrance of the fixing nip in the rotation direction of the fixing belt 200, and contacts with the sheet-passing region corresponding to the recording sheet with the smallest size among the plurality of sizes handled in the fixing performed by the fixing device 100. For example, the thermistor 252 contacts with the central area on the fixing belt 200 in the case of central sheet-transportation, and contacts with the area in the proximity of the left end of the fixing belt 200 in the case of one-side sheet-transportation with reference to the left side.

A controller 251 included in the image formation apparatus 1 controls the high-frequency inverter 250 so that the surface temperature of the fixing belt 200 detected by the thermistor 252 falls within a predetermined appropriate range of the fixing temperature. The predetermined appropriate range of the fixing temperature depends on the type of toner to be fixed. For example, the range is approximately 100° C. to 200° C. The surface temperature of the fixing belt 200 may be measured with a contactless temperature sensor as an alternative to the thermistor 252.

[3] Operations of Fixing Device 100

Next, the following describes operations for fixing performed by the fixing device 100.

When fixing a toner image on a recording sheet, the excitation coil 240 generates alternating flux due to high-frequency power supplied by the high-frequency inverter 250. The alternating flux so generated is led to the fixing belt 200 by the magnetic cores. If the heat generation control layer 312 has a lower temperature (e.g. room temperature) than its Curie temperature, there is almost no possibility that the alternating flux penetrates through the heat generation control layer 321 and leaks toward the fixing roller 103, because the heat generation control layer 312 has a high magnetic permeability and exhibits the shielding effect at such a temperature.

That is, when the temperature is lower than the Curie temperature, most of the alternating flux travels through the primary heat generator layer 302, the reinforcing layer 301 and the heat generation control layer 312 along the circumference of the fixing belt 200, and returns to the flux generator 13. The magnetic flux density is therefore very high in these layers.

However, since the primary heat generator layer 302 has a lower volume resistivity than the reinforcing layer 301 and the heat generation control layer 312, the primary heat generator layer 302 generates the largest amount of heat among these layers. During warming up, for example, the temperature of the heat generation control layer 312 is lower than the Curie temperature, and therefore the primary heat generator layer 312 generates a large amount of heat. In addition, in the present embodiment, the layers contributing to the heat generation by electromagnetic induction, namely the reinforcing layer 301, the primary heat generator layer 302 and the heat generation control layer 312, have a low thermal capacity, and the fixing belt 200 is thermally insulated by the heat insulating layer 222. Hence, it takes only a short time to raise the temperature.

Furthermore, since the reinforcing layer 301 and the primary heat generator layer 302 are thinner than the skin depths of their respective materials, the primary heat generator layer 302 generates a large amount of heat. This is for the following reasons. Generally, eddy current, which is led to a conductive layer when high-frequency alternating flux is applied, mostly flows near the surface of the conductive layer due to the skin effect, and not a large amount of current flows deep in the layer. The penetration depth δ, which shows the degree of skin effect, is represented by the following formula using the frequency f of the alternating magnetic field, the magnetic permeability μ of the conductive layer, and the volume resistivity ρ of the conductive layer:

$$\delta = \sqrt{\frac{\rho}{\pi \cdot f \cdot u}}.$$

Here, the penetration depth δ indicates the depth at which the current density is 1/e of the current density at the surface of the conductive layer. The sign e denotes the base of the natural logarithm, which is also referred to as Napier's constant. The sign π denotes the ratio of a circle's circumference to its diameter. The skin resistance R, which is the resistance per penetration depth δ, can be represented by the following formula:

$$R = \frac{\rho}{\delta}.$$

Using the skin resistance R, the heat generation amount P of the conductive layer can be represented by the following formula:

$$P = R \cdot I^2.$$

The sign I denotes the amount of the eddy current.

The skin depth d indicates the depth at which the current amount is 1/e of the current amount at the surface of the conductive layer, which is substantially equal to the penetration depth δ.

In a case of a magnetic material, the region where the eddy current flows is limited due to the skin effect regardless of the thickness of the entire layer, and therefore the current density is large, and accordingly the heat generation amount is large. In the case of a non-magnetic material, the skin effect is not significant, and the current flows all across the layer. Therefore, the current density changes depending on the thickness of the entire layer. In the present embodiment, the primary heat generator layer 302 made of a non-magnetic material is formed to be thin, and thus a high current density is realized and the amount of heat generation is increased. Also, the primary heat generator layer 302 has a lower volume resistivity than the reinforcing layer 301, and the eddy current generated in the reinforcing layer 301 is likely to flow into the primary heat generator layer 302. Thus, the current density in the primary heat generator layer 302 is further increased.

The heat generation control layer 312 made of a magnetic material has a larger thickness than the skin depth of the magnetic material. Thus, eddy current is unlikely to flow deep into the heat generation control layer 312, and this suppresses heat generation. Accordingly, heat generation by the supporting member 210, which is desired not to generate heat, will be suppressed.

The heat generated by electromagnetic induction is conducted to the surface of the fixing belt 200 via the elastic layer 304 laminated on the primary heat generator layer 302. Subsequently, when the surface temperature of the fixing belt 200 reaches the fixing temperature, a recording sheet P is passed through the fixing nip such that the surface of the recording sheet P carrying a toner image faces the fixing belt 200. Thus, the toner is fused, and is pressed and fixed to the recording sheet P.

The recording sheet P having passed through the fixing nip is released from the fixing belt 200, and is transported to the ejection roller 124. In the case the recording sheet P is stuck to the fixing belt 200 even after passing through the fixing nip, the separation nail 260 forcibly separates the recording sheet P from the fixing belt 200. This prevents paper jams from occurring in the fixing device 100. The tip of the separation nail 260 may be in contact with the fixing belt 200.

[4] Temperature Control for Fixing Belt 200

Next, the following describes the temperature control for the fixing belt 200.

When the surface temperature of the fixing belt 200 drops because the fixing belt 200 loses heat due to the transportation of the recording sheet P and the fusing of the toner, the thermistor 252 detects the temperature drop and the controller 251 controls the high-frequency inverter 250, and thus the surface temperature of the fixing belt 200 is controlled.

When small recording sheets are consecutively transported, the controller 251 controls the high-frequency inverter 250 in order to maintain the surface temperature of the sheet conveyance region of the fixing belt 200 to be within an appropriate temperature range. In the non-sheet conveyance region of the fixing belt 200, a temperature rise occurs along with the control performed by the high-frequency inverter 250. This is because the non-sheet conveyance region does not lose heat due to the transportation of the recording sheet P and the fusing of the toner. When the temperature of the non-sheet conveyance region on the heat generation control layer 312 exceeds the Curie temperature, the magnetic permeability is greatly decreased in that region, and the shielding effect is decreased.

As a result, the magnetic flux will be allowed to penetrate through the non-sheet conveyance region on the heat generation control layer 312, and furthermore leaks to the supporting heat generation layer 311 located closer to the inner circumference of the fixing belt 200. In the non-sheet conveyance region, the density of the magnetic flux passing through the reinforcing layer 301, the primary heat generator layer 302 and the heat generation control layer 312 in the circumferential direction greatly decreases, and accordingly the amount of heat generated in the non-sheet conveyance region greatly decreases.

On the other hand, eddy current is led to the non-sheet conveyance region on the supporting heat generation layer 311 due to the leaked magnetic flux. In particular, since the supporting heat generation layer 311 of the present embodiment is made of an aluminum having a low resistance, eddy current easily flows through the supporting heat generation layer 311, but almost no heat is generated. In addition, back electromotive force caused by the eddy current occurring in the supporting heat generation layer 311 cancels out the magnetic flux. Furthermore, the amount of heat generation is reduced due to the thickness of the supporting heat generation layer 311, because the supporting heat generation layer 311 is thicker than the other layers.

Thus, the magnetic flux density is further decreased in the non-sheet conveyance region on the reinforcing layer 301, the primary heat generator layer 302 and the heat generation control layer 312, and the amount of heat generation is further reduced. Thus, in the region where the temperature of the heat generation control layer 312 is higher than the Curie temperature, every layer of the fixing belt 200, at any height in the radius direction of the fixing belt 200, generates almost no heat. Therefore, the amount of heat generated in the region where an excessive temperature rise occurs is effectively prevented.

On the other hand, in the region where no excessive temperature rise occurs, the amount of heat generation is kept without being reduced, and excellent fixing performance will be maintained. Thus, the fixing device achieves a high thermal efficiency in total.

Furthermore, the fixing belt 200 and the heat generation control layer 312 in the present embodiment are located close to each other, and therefore the changes in the surface temperature of the fixing belt 200 is quickly conducted to the heat generation control layer 312. Hence, when the temperature of a portion of the surface of the fixing belt 200 exceeds the appropriate temperature for the fixing, the amount of heat generated at the portion is immediately and greatly decreased, which swiftly resolves the excessive temperature rise. The Curie temperature of the heat generation control layer 312 in the present embodiment is determined to meet this purpose.

In the present embodiment, the heat generation control layer 312 and the supporting heat generation layer 311 are fixedly arranged, and therefore the thermal capacity of the fixing belt 200 is smaller than the case where the above-mentioned layers are layered on the fixing belt 200. Due to such reduction of the thermal capacity, the warm-up time can be reduced.

Furthermore, the primary heat generator layer 302 of the present embodiment is made of copper. Thus, the primary heat generator layer 302 is a thin layer and has a low resistance, and the current density in the primary heat generator layer 302 is increased, and a high heat generation efficiency is achieved. Also, since each of the reinforcing layer 301 and the primary heat generator layer 302 has a low thermal capacity, the warm-up time is short.

[5] Conclusion

As described above, in the fixing device 100 pertaining to the present embodiment, the fixing belt 200 has a multilayer structure including the primary heat generator layer 302, which is non-magnetic and is thinner than the skin depth of its material, and the reinforcing layer 301, which is magnetic and thinner than the skin depth of its material, where the flux generator 101 faces the reinforcing layer 301 with the primary heat generator layer 302 interposed therebetween. Such a structure achieves high heat generation efficiency, because the eddy current density in the primary heat generator layer 302 is high, and also achieves sufficient strength.

The fixing member 102 includes a heat generation control layer 312 which is magnetic and is thicker than the skin depth of its material. The reinforcing layer 301 and the heat generation control layer 312 have a higher specific resistance than the primary heat generator layer 302, and the heat generation control layer 312 has a lower Curie temperature than the reinforcing layer 301. Hence, when the temperature of the reinforcing layer 301 exceeds the Curie temperature, the heat generation by the fixing belt is furthermore suppressed. This prevents abnormal temperature rise. Also, such a structure prevents rapid changes in temperature, and maintains high fixing performance.

When the temperature of a portion of the fixing belt 200 rises and the temperature of the heat generation control layer 312 exceeds its Curie temperature (e.g. when the excessive temperature rise occurs in the non-sheet conveyance region), the magnetic permeability at the portion of the heat generation control layer 312 is greatly decreased, and accordingly the magnetic flux density decreases and the heat generation amount decreases. This resolves the excessive temperature rise. In other words, the non-sheet conveyance region is prevented from being overheated when small sheets are sequentially conveyed, and in this respect, the stated structure effectively self-adjusts the heat generation amount and achieves stable fixing performance.

[6] Modifications

The present embodiment has been described above based on Embodiment. However, the present invention is not limited to Embodiment, and the following modifications may be adopted.

(1) In Embodiment above, a color printer is taken as an example. However, the present invention is not limited to this, as a matter of course. The present invention may be applied to a monochrome printer. Before the fixing, a toner image in monochrome is thinner than a toner image in color. Hence, in the case of a monochrome printer, sufficiently high fixing performance can be achieved even when the elastic layer 304 is omitted from the fixing belt 200. If this is the case, the heat generation efficiency can be further improved.

(2) In Embodiment described above, a printer is taken as an example. However, the present invention is not limited to this, as a matter of course. The present invention may be applied to a fax and a copier. Also, even when the present invention is applied to a Multi-Function Peripheral (MFP), the same advantageous effects can be achieved as with the case where the present invention is applied to a printer.

[7] Advantageous Effects of Invention

As described above, a fixing device pertaining to the present invention is a fixing device for fixing a toner image on a recording sheet after fusing the toner image by using a fixing belt heated due to electromagnetic induction caused by an excitation coil, comprising: an endless fixing belt having a multilayer structure including a non-magnetic conductive layer and a first magnetic conductive layer, the non-magnetic conductive layer having a thickness smaller than a skin depth of a material thereof, the first magnetic conductive layer having a thickness smaller than a skin depth of a material thereof and being located farther from an outside surface of the endless fixing belt than the non-magnetic conductive layer; and a supporting member disposed inside the endless fixing belt and including a second magnetic conductive layer having a thickness larger than a skin depth of a material thereof, wherein the first magnetic conductive layer and the second magnetic conductive layer have a higher specific resistance than the non-magnetic conductive layer, and the first magnetic conductive layer has been manufactured by plastic forming or plating.

With the stated structure, the non-magnetic conductive layer as the primary heat generator layer and the first magnetic conductive layer as the reinforcing layer are thinner than the skin depths of their respective materials. Hence, this structure increases the induced current density, and achieves high heat generation efficiency.

When the temperature of the fixing belt is below the fixing temperature, the first magnetic conductive layer has a higher specific resistance than the non-magnetic conductive layer, and therefore the induced current generated in the first magnetic conductive layer leaks to the non-magnetic conductive layer and increases the current density in the non-magnetic conductive layer, which further improves the heat generation efficiency.

In addition, since at least one of the first magnetic conductive layer and the second magnetic conductive layer has been manufactured by plastic forming or plating, the mechanical strength is enhanced.

An image formation apparatus pertaining to the present invention is characterized by including a fixing device pertaining to the present invention. With this structure, the image formation apparatus can achieve the advantageous effects achieved by the fixing device pertaining to the present invention.

When the second magnetic conductive layer has a lower Curie temperature than the first magnetic conductive layer, the amount of heat generated by the fixing belt is further reduced when the temperature of the first magnetic conductive layer exceeds the Curie temperature. This prevents abnormal temperature rise. Also, such a structure prevents rapid changes in temperature, and maintains high fixing performance.

When the fixing belt further includes an elastic layer and a releasing layer, the non-magnetic conductive layer is coated with an antioxidant layer, and the elastic layer and the releasing layer are laminated on the antioxidant layer, such a structure prevents oxidization of the non-magnetic conductive layer, and keeps the non-magnetic conductive layer and the elastic layer bonded to each other in a preferable state. This enhances the mechanical strength.

Also, when the non-magnetic conductive layer is made of copper, high heat generation efficiency can be achieved.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A fixing device for fixing a toner image on a recording sheet after fusing the toner image by using a fixing belt heated due to electromagnetic induction caused by an excitation coil, comprising:

an endless fixing belt having a multilayer structure including a non-magnetic conductive layer and a first magnetic conductive layer, the non-magnetic conductive layer having a thickness smaller than a skin depth of a material thereof, the first magnetic conductive layer having a thickness smaller than a skin depth of a material thereof and being located farther from an outside surface of the endless fixing belt than the non-magnetic conductive layer; and a supporting member disposed inside the endless fixing belt and including a second magnetic conductive layer having a thickness larger than a skin depth of a material thereof, wherein the first magnetic conductive layer and the second magnetic conductive layer have a higher specific resistance than the non-magnetic conductive layer, and the first magnetic conductive layer has been manufactured by a process selected from the group consisting of plastic forming and plating.

2. The fixing device of claim 1, wherein the second magnetic conductive layer has a lower Curie temperature than the first magnetic conductive layer.

3. The fixing device of claim 1, wherein the fixing belt further includes an elastic layer and a releasing layer, the non-magnetic conductive layer is coated with an antioxidant layer, and the elastic layer and the releasing layer are laminated on the antioxidant layer.

4. The fixing device of claim 1, wherein the non-magnetic conductive layer is made of copper.

5. The fixing device of claim 1, wherein the first magnetic conductive layer is made of a material selected from the group consisting of nickel and SUS.

6. The fixing device of claim 1, wherein the first magnetic conductive layer is manufactured by plating.

7. The fixing device of claim 1, wherein the supporting member is in contact with the endless fixing belt to support the endless fixing belt.

8. An image formation apparatus, comprising:

a fixing device for fixing a toner image on a recording sheet after fusing the toner image by using a fixing belt heated due to electromagnetic induction caused by an excitation coil, the fixing device including:

an endless fixing belt having a multilayer structure including a non-magnetic conductive layer and a first magnetic conductive layer, the non-magnetic conductive layer having a thickness smaller than a skin depth of a material thereof, the first magnetic conductive, layer having a thickness smaller than a skin depth of a material thereof and being located farther from an outside surface of the endless fixing belt than the non-magnetic conductive layer; and a supporting member disposed inside the endless fixing belt and including a second magnetic conductive layer having a thickness larger than a skin depth of a material thereof, wherein the first magnetic conductive layer and the second magnetic conductive layer have a higher specific resistance than the non-magnetic conductive layer, and the first magnetic conductive layer has been manufactured by a process selected from the group consisting of plastic forming and plating.

9. The image formation apparatus of claim 8, wherein the second magnetic conductive layer has a lower Curie temperature than the first magnetic conductive layer.

10. The image formation apparatus of claim 8, wherein the fixing belt further includes an elastic layer and a releasing layer, the non-magnetic conductive layer is coated with an antioxidant layer, and the elastic layer and the releasing layer are laminated on the antioxidant layer.

11. The image formation apparatus of claim 8, wherein the non-magnetic conductive layer is made of copper.

12. The image formation apparatus of claim 8, wherein the first magnetic conductive layer is made of a material selected from the group consisting of nickel and SUS.

13. The image formation apparatus of claim 8, wherein the first magnetic conductive layer is manufactured by plating.

14. The image formation apparatus of claim 8, wherein the supporting member is in contact with the endless fixing belt to support the endless fixing belt.

15. A fixing device for fixing a toner image on a recording sheet after fusing the toner image by using a fixing belt heated due to electromagnetic induction caused by an excitation coil, comprising:

an endless fixing belt having a multilayer structure including a non-magnetic conductive layer and a first magnetic conductive layer, the non-magnetic conductive layer having a thickness smaller than a skin depth of a material thereof, the first magnetic conductive layer having a thickness smaller than a skin depth of a material thereof and being located farther from an outside surface of the endless fixing belt than the non-magnetic conductive layer; and a supporting member disposed inside the endless fixing belt and including a second magnetic conductive layer having a thickness larger than a skin depth of a material thereof, wherein the first magnetic conductive layer and the second magnetic conductive layer have a higher specific resistance than the non-magnetic conductive layer, and the first magnetic conductive layer has been manufactured by plastic forming or plating, without annealing.

16. An image formation apparatus, comprising the fixing device of claim 15.

* * * * *